US007561830B2

(12) United States Patent
Watahiki

(10) Patent No.: US 7,561,830 B2
(45) Date of Patent: Jul. 14, 2009

(54) ROTATION DEVICE, METHOD FOR CONTROLLING ROTATION OF A DRIVING SOURCE, COMPUTER READIBLE MEDIUM AND IMAGE FORMING APPARATUS INCLUDING THE ROTATION DEVICE

(75) Inventor: Tatsuya Watahiki, Sagamihara (JP)

(73) Assignee: Ricoh Company, Ltd., Tokyo (JP)

( * ) Notice: Subject to any disclaimer, the term of this patent is extended or adjusted under 35 U.S.C. 154(b) by 158 days.

(21) Appl. No.: 11/723,267

(22) Filed: Mar. 19, 2007

(65) Prior Publication Data

US 2007/0231009 A1 Oct. 4, 2007

(30) Foreign Application Priority Data

Mar. 20, 2006 (JP) ..... 2006-076713

(51) Int. Cl.
*G03G 15/01* (2006.01)
*G03G 15/16* (2006.01)

(52) U.S. Cl. ..... 399/167; 399/394

(58) Field of Classification Search ..... 399/167, 399/159, 394, 301
See application file for complete search history.

(56) References Cited

U.S. PATENT DOCUMENTS

| | | | | |
|---|---|---|---|---|
| 5,636,193 | A | 6/1997 | Ohmi | 369/53 |
| 2002/0012549 | A1 | 1/2002 | Oku | 399/167 |
| 2003/0161663 | A1* | 8/2003 | Yanagida | 399/167 |
| 2005/0129427 | A1* | 6/2005 | Kinoshita et al. | 399/167 |
| 2005/0271418 | A1* | 12/2005 | Kojima | 399/167 |
| 2007/0122194 | A1* | 5/2007 | Imai | 399/167 |

FOREIGN PATENT DOCUMENTS

| | | |
|---|---|---|
| JP | 2001-197765 | 7/2001 |
| JP | 2005-091400 | 4/2005 |
| JP | 2005-094987 | 4/2005 |

OTHER PUBLICATIONS

Extended European Search Report for corresponding European Patent Application No. 07 251 180.1 dated Jul. 25, 2007.

* cited by examiner

*Primary Examiner*—Sophia S Chen
(74) *Attorney, Agent, or Firm*—Harness, Dickey & Pierce, P.L.C.

(57) ABSTRACT

A rotation device includes a rotation member, rotation driving source, transmission mechanism, rotation pulse generation mechanism, target value arrangement mechanism, correction value computation mechanism, and control mechanism. The transmission mechanism decreases the rotation speed at a non-integer gear ratio. The target value arrangement mechanism includes a rotation unevenness provision mechanism to impart a plurality of kinds of sine-wave unevenness to the rotation speed target value. The correction value computation mechanism determines the correction value to adjust rotation fluctuation caused by a rotation axis eccentricity component of the rotation driving source and at least one noise component having a cycle relationship with a rotation cycle of the rotation member based on a time interval of a pulse train generated every rotation of the rotation member by the rotation pulse generation mechanism when the plurality of kinds of the rotation unevenness are imparted to the rotation speed target value.

14 Claims, 10 Drawing Sheets

ROTATION DEVICE, METHOD FOR CONTROLLING ROTATION OF A DRIVING SOURCE, COMPUTER READIBLE MEDIUM AND IMAGE FORMING APPARATUS INCLUDING THE ROTATION DEVICE

PRIORITY STATEMENT

This patent application is based on Japanese patent application No. 2006-076713, filed on Mar. 20, 2006 in the Japan Patent Office, the entire contents of which are hereby incorporated herein by reference.

BACKGROUND

1. Field

Example embodiments of the present application generally relate to a rotation device to control a rotation driving source such as motors, and to a rotation controlling method, a computer readable medium including a rotation controlling program and an image forming apparatus including the rotation device.

2. Description of the Related Art

Recently, rotation devices for rotating a rotation member, which have a motor and a transmission mechanism to transmit rotation of the motor to the rotation member, are used to various fields, and are demanded to increase accuracy thereof. For example, image forming apparatuses such as printers, copiers, facsimile, etc. employing an electrophotographic method to form a toner image writes an electrostatic latent image on a photoconductor drum by controlling a laser diode (LD) based on image data to form a laser beam and scanning the photoconductor drum with the laser beam in a main-scanning direction while moving the photoconductor drum in a sub-scanning direction. In this regards, the image forming apparatus performs sub-scanning by. rotating the photoconductor drum. When the rotation speed of the photoconductor drum (i.e., sub-scanning speed) fluctuates, the positions of the main-scanning lines vary, resulting in deterioration of image quality.

Particularly, in a color image forming process, a full color image is formed by performing the laser beam scanning four times to form the four color images. Therefore, the sub-scanning speed needs to remain constant to reduce color misalignment. Thus, when the sub-scanning speed fluctuates, image quality deteriorates. Therefore, in order to accurately maintain the rotation speed of a photoconductor drum at a constant level, it is important to control the motor driving the photoconductor drum.

In a related art driving control technique, the rotation angular displacement or rotation angular speed of a rotation axis of a motor driving a photoconductor drum are detected and the rotation of the motor is controlled based on the detection result.

Such driving control reduces rotation speed fluctuation of the motor, thereby rotating the motor at a constant speed. In this way, the driving control may reduce an occurrence of image misalignment and image quality deterioration such as color deviation caused by rotation speed fluctuation of the photoconductor drum resulting from the rotation speed fluctuation of the motor. However, even when the motor rotates at a constant speed, the photoconductor causes the rotation speed fluctuation resulting from eccentricity of each rotation axis.

One example attempts to reduce an influence of the rotation speed fluctuation on a photoconductor drum in a tandem image forming apparatus having four photoconductor drums for four colors. This tandem image forming apparatus forms registration patterns for four colors on an intermediate transfer belt serving as an intermediate transfer member on which the toner image is transferred, and detects the registration patterns by using a sensor. The tandem image forming apparatus determines an eccentric phase component including eccentricity of each photoconductor drum and eccentricity of members such as gears for transmitting to driving force of the driving motor to the photoconductor drum. Therefore, the tandem image forming apparatus controls the motor based on the determined eccentricity and eccentric phase component to decrease phase lag, thereby reducing an occurrence of color misalignment.

Another example attempts to detect the rotation speed fluctuation of a photoconductor drum in image forming apparatus without using an encoder to control a motor based on the detection result such that the photoconductor is not fluctuated. When the image forming apparatus controls the rotation speed of the motor to be a certain level, the image forming apparatus detects a time interval T1 of pulses generated after every half-turn of the photoconductor drum. Then, the image forming apparatus controls the motor by using a measurement sine-wave reference signal that is fluctuated by a rotation cycle of the photoconductor drum, and detects a time interval T2 of pulses generated after every half-turn of the photoconductor drum. The image forming apparatus determines the amplitude and phase of the rotation speed fluctuation of one rotation cycle of the photoconductor drum (i.e., speed fluctuation caused by the eccentricity of the photoconductor drum axis) based on the detection results of T1 and T2. The image forming apparatus controls the motor such that the speed fluctuation of the photoconductor drum is reduced, and the photoconductor drum rotates at a speed.

SUMMARY

According to at least one example embodiment of the invention, a rotation device includes a rotation member, a rotation driving source, a transmission mechanism, a rotation pulse generation mechanism, a target value arrangement mechanism, a correction value computation mechanism, and a control mechanism. The rotation driving source is capable of controlling rotation speed thereof. The transmission mechanism transmits a rotation from the rotation driving source to the rotation member by decreasing the rotation speed of the rotation driving source. The transmission mechanism decreases the rotation speed at a non-integer gear ratio. The rotation pulse generation mechanism configured to generate a pulse at a certain rotation angle of the rotation member.

The target value arrangement mechanism arranges a target value of the rotation speed of the rotation driving source. The target value arrangement mechanism includes a rotation unevenness provision mechanism to impart a plurality of kinds of sine-wave unevenness to the rotation speed target value.

The correction value computation mechanism determines a correction value with respect to the target value of the rotation speed of the rotation driving source based on the pulse generated by the rotation pulse generation mechanism. The correction value computation mechanism determines the correction value to adjust rotation fluctuation caused by a rotation axis eccentricity component of the rotation driving source and at least one noise component having a cycle relationship with a rotation cycle of the rotation member based on a time interval of a pulse train generated every rotation of the rotation member by the rotation pulse generation mechanism when the plurality of kinds of the rotation unevenness are imparted to the rotation speed target value.

The control mechanism controls the output rotation speed of the rotation driving source according to the correction value determined by the correction value computation mechanism.

According to at least one other example embodiment of the invention, a rotation control method controls rotation speed of a rotation member, which is rotated by a rotation driving source via a transmission mechanism having a non-integer gear ratio, so as be a rotation speed target value. The rotation control method includes imparting, detecting, determining, and correcting.

The imparting imparts a plurality of kinds of rotation unevenness having a waveform to the rotation speed target value. The detecting detects pulses generated at a certain rotation angle of the rotation member when the plurality of kinds of rotation unevenness are imparted to the rotation speed target value to determine a time interval of a pulse train generated every rotation. The determining determines a correction value based on the time interval of the pulse train to adjust rotation fluctuation caused by a rotation axis eccentricity of the rotation driving source and a noise component having a cycle relationship with a rotation cycle of the rotation member. The correcting corrects the rotation speed target value by using the correction value.

BRIEF DESCRIPTION OF THE DRAWINGS

A more complete appreciation of the disclosure and many of the attendant advantages thereof will be readily obtained as the same becomes better understood by reference to the following detailed description of example embodiments when considered in connection with the accompanying drawings, wherein.

Figure 1:
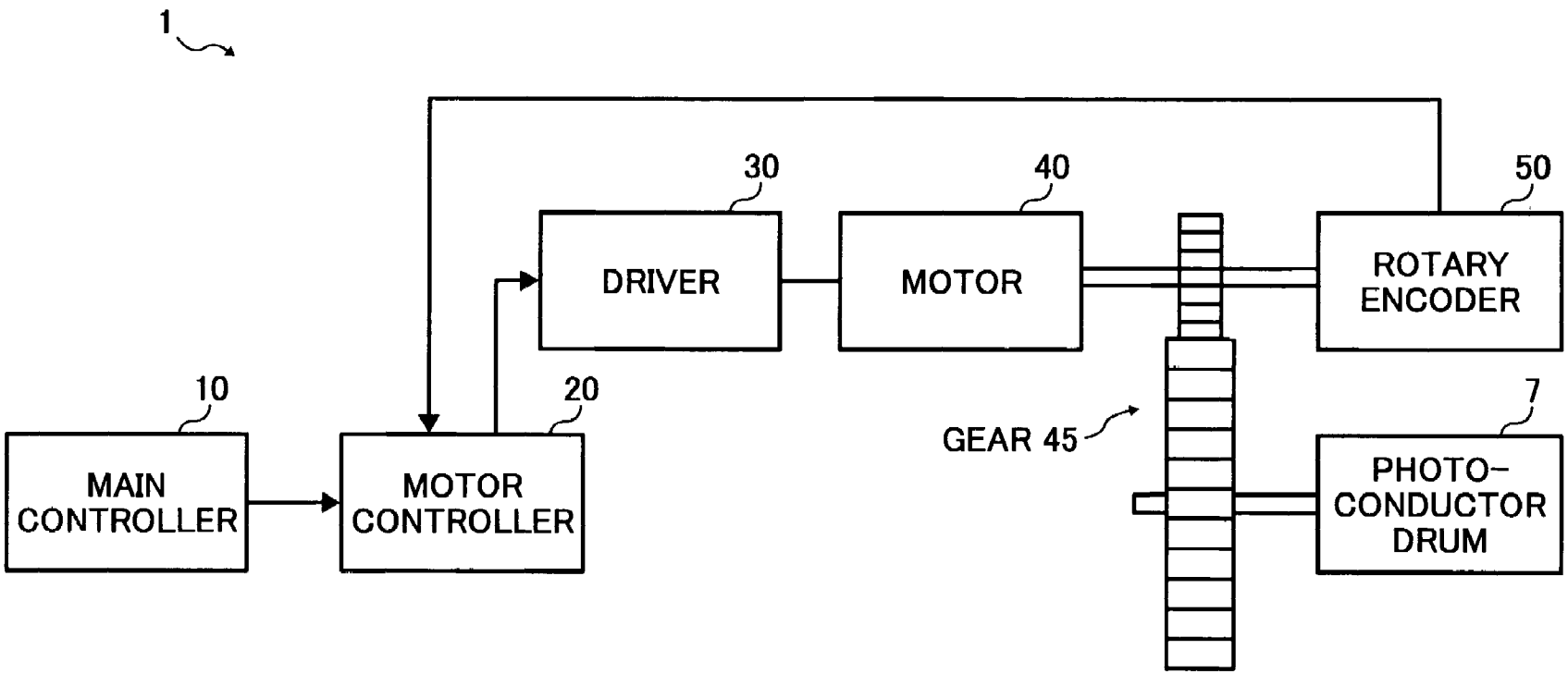
FIG. 1 is a schematic diagram illustrating a rotation device of a photoconductor drum in an image forming apparatus according to an example embodiment of the present invention.

The accompanying drawings are intended to depict example embodiments of the present invention and should not be interpreted to limit the scope thereof. The accompanying drawings are not to be considered as drawn to scale unless explicitly noted.

DETAILED DESCRIPTION OF EXAMPLE EMBODIMENTS

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would hen be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Reference is now made to the drawings, wherein like reference numerals designate identical or corresponding parts throughout the several views.

Referring to FIG. 1, a rotation device 1 for rotating a photoconductor drum 7 of the image forming apparatus of an example embodiment of the present invention is illustrated. The rotation device 1 includes a motor controller 20, a driver 30, a motor 40, a gear 45, and a rotary encoder 50.

The photoconductor drum 7 serving as the rotation member forms an electrostatic latent image thereon by optical beams. The motor 40 drives the photoconductor 7. The motor controller 20 controls the motor 40 through the driver 30. The gear 45 transmits rotation of the motor 40 to the photoconductor drum 7. The rotary encoder 50 detects the rotation displacement of a rotation axis of the motor 40. The motor controller 20, which receives a signal corresponding to the rotation displacement detected by the rotary encoder 50 and a rotation speed instruction value from a main controller 10 of the image forming apparatus, controls the motor 40 to rotate the photoconductor drum at the instructed speed on the basis of the rotation displacement signal speed instruction value. The operation of the rotation device 1 in the image forming apparatus will be explained below.

The photoconductor drum 7 forms an electrostatic latent image thereon by a light scanning method in which a light beam irradiates surface of the photoconductor drum 7 in the two-dimensional scanning directions, i.e., main-scanning and sub-scanning directions. In the main-scanning operation, a light source is controlled based on image data to emit a light beam, and the beam is deflected by a rotation mirror so that the beam scans the photoconductor drum in the direction parallel to the axis of the photoconductor drum. Thus, a latent line image is formed on the main-scanning line. The sub-scanning is performed by rotating the photoconductor drum. Since axis of the photoconductor drum 7 is rotated, the surface of the photoconductor drum 7 is moved in a direction (sub-scanning direction) perpendicular to the main-scanning direction. Therefore, another latent image is formed on the next main-scanning line at an interval feeding. By repeatedly performing the main scanning while rotating the photoconductor drum, a plurality of latent line images are formed in the sub-scanning direction, resulting in formation of a latent image. Since the beams are deflected at a certain scanning cycle in the main-scanning direction, the photoconductor drum 7 needs to rotate at constant speed in the sub-scanning direction. The lower the rotation speed and the smaller the speed fluctuation of the photoconductor drum 7, the higher the image resolution in a sub-scanning direction and the smaller the image unevenness. Therefore, the high quality image is formed.

The electrostatic latent image formed on the photoconductor drum 7 is developed, transferred, and fixed by a series of the image forming processes. In other words, the electrostatic latent image is developed by a toner, and the toner image is transferred on a transfer sheet, following by fixation on the transfer sheet to complete the series of the image forming processes.

As shown in FIG. 1, the gear 45 is located on the rotation axis of the motor 40 so that the photoconductor drum 7 rotates at a relatively slow speed. The rotation of the motor 40 is transmitted to the photoconductor 7 through the gear 45. When the transmission mechanism transmitting the rotation of the motor 40 to the photoconductor drum 7 includes substantially no error, the photoconductor drum 7 rotates at the constant speed in accordance with the instruction value.

The rotation device 1 is applied to the image forming apparatus of the example embodiment of the present invention. However, the rotation device 1 can be applied to a device that transmits rotation of a motor to a rotation member through a transmission mechanism (for example, gears), and rotates the rotation member at a speed by driving control of the motor.

The image forming apparatus employing the electrophotographic method that forms the electrostatic latent image on a rotation member by two-dimensional scanning is used in this example embodiment. However, the example embodiment can be applied to a device that drives a rotation member at a constant speed so as to form the electrostatic latent image by the two-dimensional scanning.

Figure 2:
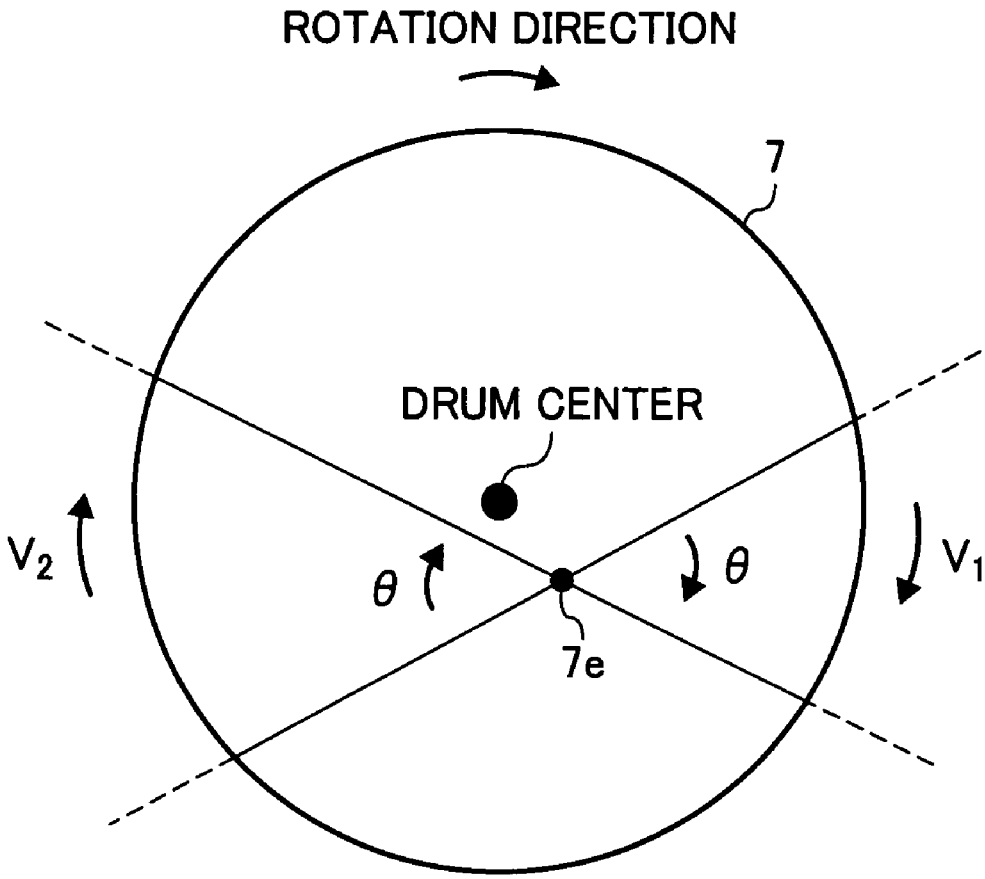
FIG. 2 is a schematic diagram illustrating rotation fluctuation of the photoconductor drum of FIG. 1 caused by eccentricity of a rotation axis thereof.

Referring to FIG. 2, the speed fluctuation caused by the eccentricity of a rotation axis 7*e* of the photoconductor drum 7 is illustrated. For example, when the rotation axis 7*e* of the photoconductor drum 7 is eccentric to the center of the photoconductor drum 7, the surface speed of the photoconductor drum 7 is not constant. Provided that the motor rotates at an angular speed $\omega$, and the surface speeds V1 and V2 are different from each other (i.e., $V1 \neq V2$) even if there is substantially no transmission error from the motor 40 to the photoconductor drum 7. Each of the surface speed V1 and V2 is the speed of the outer circumference surface of the photoconductor drum 7. The distance between the rotation axis 7*e* and the outer circumference surface for the surface speed V1 and the outer circumference surface for the surface speed V2 are different. Therefore, the surface speed of the photoconductor drum 7 is not constant.

The difference of the surface speed at the outer circumference of the photoconductor drum 7 (for example, V1 and V2) causes unevenness of the image density of the main scanning lines in the sub-scanning direction, resulting in formation of uneven images. Therefore, the difference of the surface speed influences on the image quality.

The speed fluctuation caused by eccentricity of the rotation axis of the photoconductor drum 7 can be reduced by a correction mechanism which will be described below. This correction mechanism reduces the speed fluctuation by detecting the rotation fluctuation caused by the eccentricity and performing controlling to adjust the rotation fluctuation.

Figure 3:
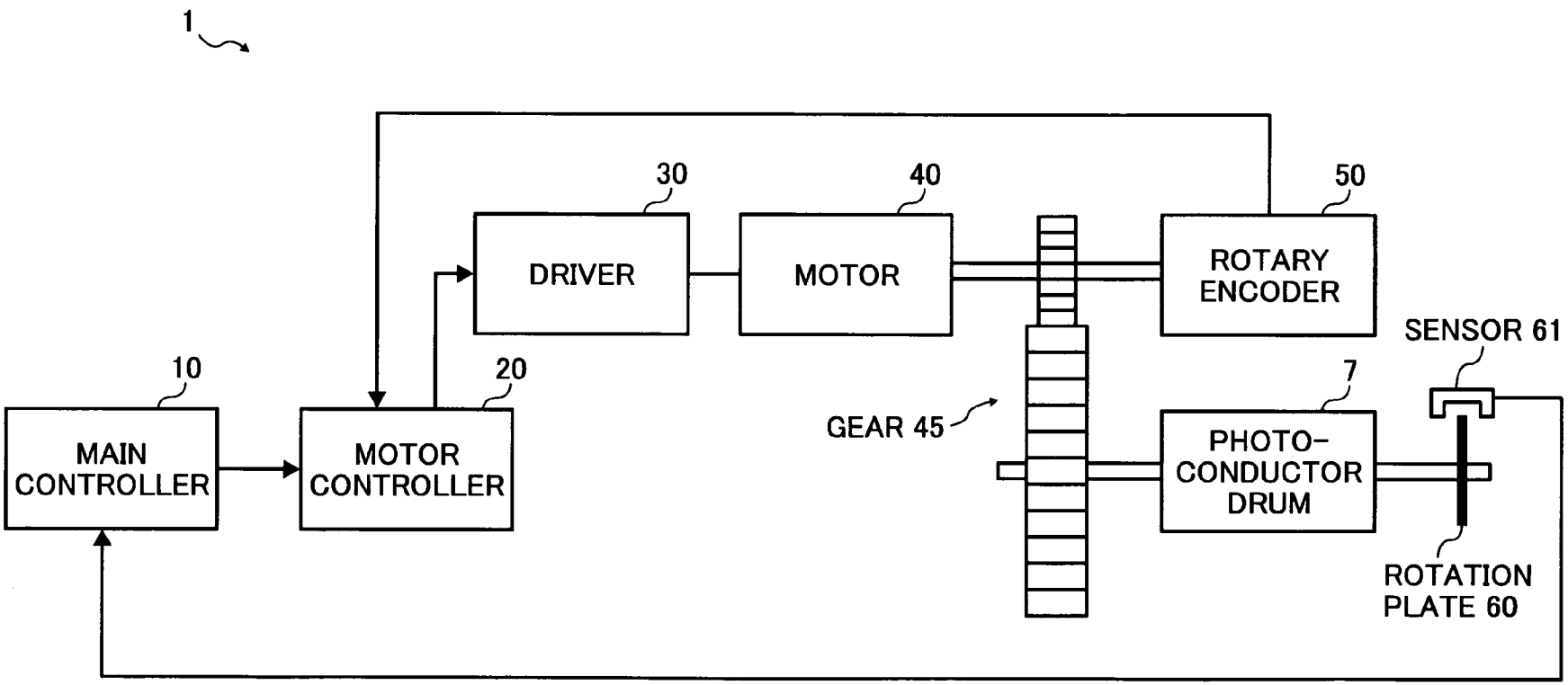
FIG. 3 is a schematic diagram illustrating the rotation device of FIG. 1 with a correction mechanism to correct the rotation fluctuation.

Referring to FIG. 3, the rotation device 1 with a correction mechanism to adjust the rotation fluctuation caused by the eccentricity is illustrated. As shown in FIG. 3, the rotation device 1 is similar to that of FIG. 1., except for a rotation plate 60 and a sensor 61. Reference numerals used in FIG. 3 and FIG. 1 are similar and description thereof will be omitted.

Figure 14:
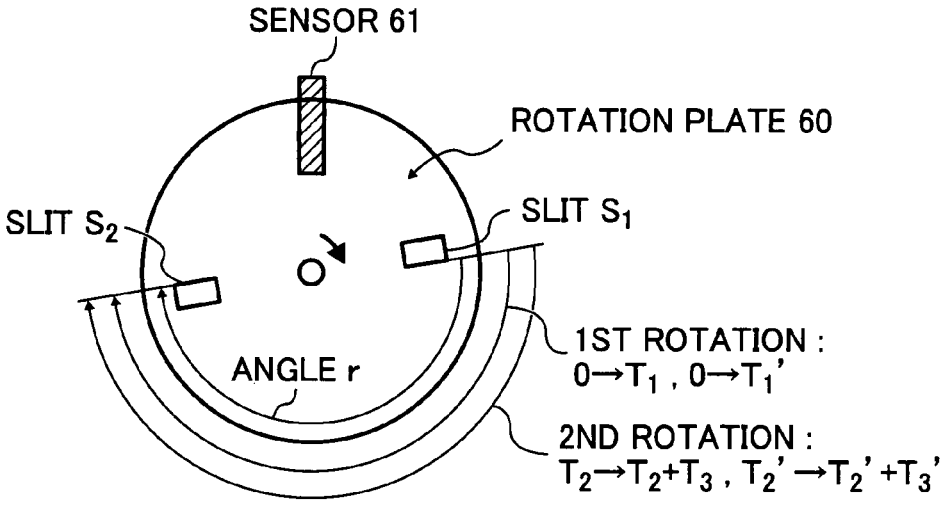
FIG. 14 is a schematic diagram illustrating the rotation plate having the two slits to detect the rotation of the photoconductor drum.

The rotation plate 60 includes a detection element, for example, a slit. This detection element generates a signal. The sensor 61 detects the signal from the detection element, and outputs a pulse of the rotation synchronization signal. The sensor 61 is located in a certain rotation position. Therefore, the sensor 61 outputs the rotation synchronization signal when the rotation plate 60 rotates. For example, the rotation plate 60 includes two splits as shown in FIG. 14. The rotation plate 60 and sensor 61 act as a rotation detection mechanism to detect the rotation fluctuation of the photoconductor drum 7 caused by the eccentricity. The rotation plate 60 rotates integrally with the rotation axis of the photoconductor drum 7. The sensor 61 outputs a rotation synchronization signal. The main controller 10 uses the rotation synchronization signal to control the rotation fluctuation of the photoconductor drum 7.

The main controller 10 recognizes the rotation speed fluctuation of the rotation plate 60 based on the time interval of the rotation synchronization signal.

Figure 4:
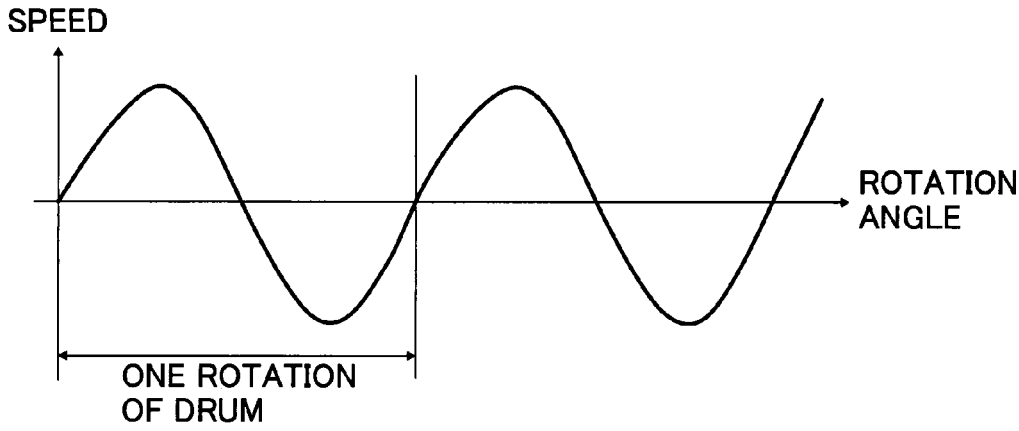
FIG. 4 is a graph illustrating the rotation fluctuation of a surface of the photoconductor drum when the rotation axis of the photoconductor drum includes the eccentricity.

When the rotation axis of the photoconductor drum 7 has the eccentricity, the surface speed of the photoconductor drum 7 is fluctuated as shown in FIG. 4.

FIG. 4 is a graph illustrates the speed fluctuation of the surface of the photoconductor drum 7 when the rotation axis is eccentric. The vertical axis of FIG. 4 indicates the speed, and the horizontal axis indicates the rotation angle. As shown in FIG. 4, the rotation speed has a sine-wave fluctuation with respect to the rotation angle wherein the center line represents the non-eccentric speed. In other words, the amplitude is proportional to the eccentricity amount.

Figure 5:
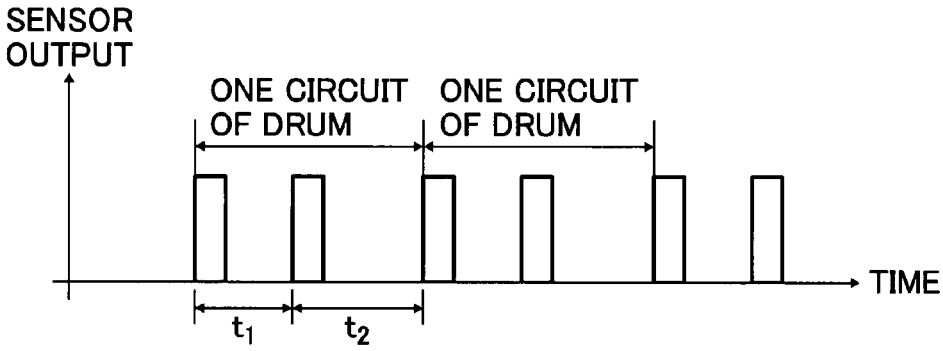
FIG. 5 is a graph illustrating a sensor output when a rotation plate having slits apart from the other by 180 degree in a rotation direction is used to detect a situation of FIG. 4.

Referring to FIG. 5, the sensor 61, which outputs the pulses when the rotation plate 60 having the slits apart from the other by 180 degree in the rotation direction (i.e., outputting a pulse every half-turn), is used to detect the situation illustrated in FIG. 4. As shown in FIG. 5, the sensor 61 outputs two pluses when the photoconductor drum 7 rotates one circuit (i.e., one revolution). The two pulses have pulse intervals t1 and t2. The vertical axis of FIG. 5 indicates a sensor output, and the horizontal axis indicates time.

By using the pulse intervals t1 and t2, the amplitude and phase of the fluctuation component caused by the eccentricity of the rotation axis of the photoconductor drum 7 can be determined. The fluctuation component is detected by the following detection method. Specifically, when the main controller 10 controls the motor 40 so as to rotate at a target rotation speed of the rotation speed, the interval between pulses generated every half-turn of the photoconductor drum 7 is detected. Then, the main controller 10 controls the motor 40 on the basis of the measured sine-wave reference signal that is fluctuated by the rotation cycle of the photoconductor drum 7, and the interval of pulses generated every half-turn of the photoconductor drum 7 is detected. The detection results of these two pulse intervals are used to determine the phase and amplitude of the rotation speed fluctuation caused by the eccentricity of the rotation axis of the photoconductor drum 7 during the one rotation cycle.

The main controller 10 is used to detect the fluctuation component of the photoconductor drum 7 in the example embodiment. However, the motor controller 20 may be used to detect the fluctuation component of the photoconductor drum 7. An example method for detecting the rotation fluctuation caused by eccentricity of a drum is described in JP-A2005-94987, the entire contents of which is hereby incorporated herein by reference.

The rotation axis of the photoconductor drum 7 has the eccentricity. However, in the rotation device 1 as shown in FIG. 3 including the gear 45 serving as the transmission mechanism, the rotation axis of the motor 40 may have the eccentricity as well.

Figure 6:
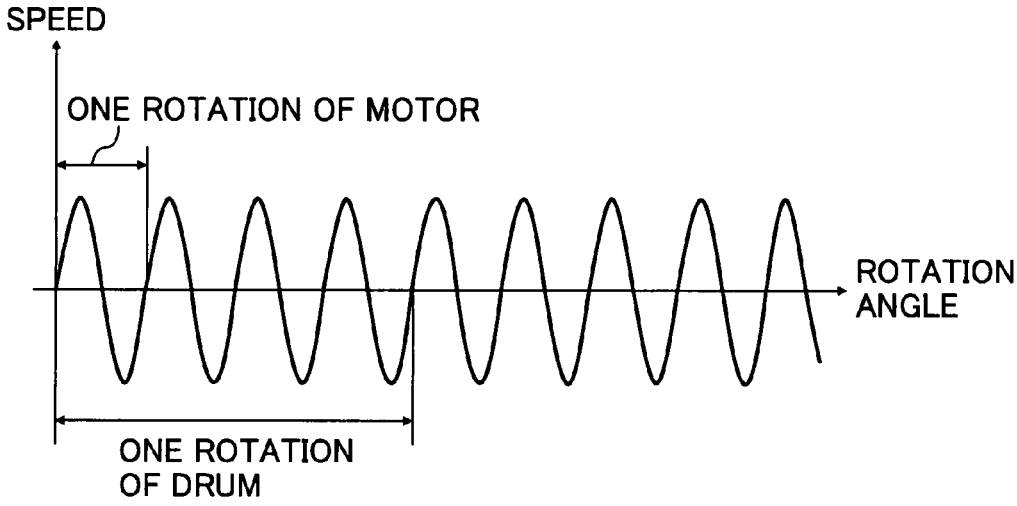
FIG. 6 is a graph illustrating speed fluctuation of the photoconductor surface when a rotation axis of a motor includes the eccentricity.

Referring to FIG. 6, the rotation speed fluctuation of the surface of the photoconductor drum 7 is illustrated. In this case, the rotation axis of the photoconductor drum 7 has substantially no eccentricity while the rotation axis of the motor 40 has an eccentricity, and the gear ratio is 4:1. The vertical axis of the FIG. 6 indicates the speed, and the horizontal axis indicates the rotation angle. The rotation speed has a sine-wave fluctuation with respect to the rotation angle wherein the center line represents the non-eccentric speed. As the gear ratio is 4:1, one rotation of the photoconductor drum 7 includes four rotations of the motor 40.

Figure 7:
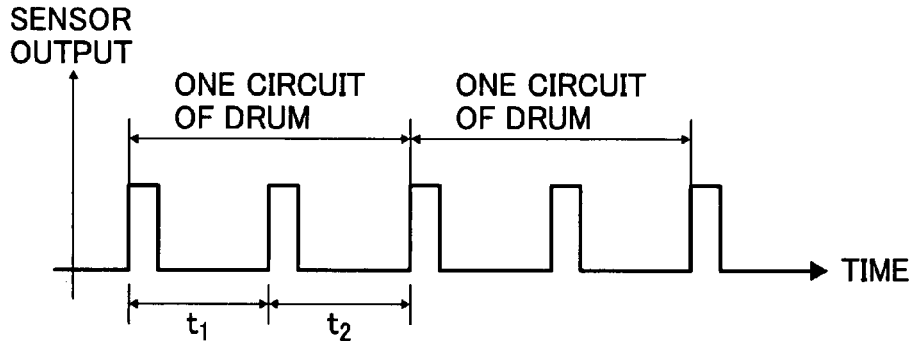
FIG. 7 is a graph illustrating another sensor output when the rotation plate having the slits apart from the other by 180 degree in the rotation direction is used to detect a situation of FIG. 6.

Referring to FIG. 7, the sensor 61 outputs the pulses when the rotation plate 60 having the slits apart from the other by 180 degree in the rotation direction (describe later in FIG. 14) is used to detect the situation illustrated in FIG. 6. As shown in FIG. 7, the sensor 61 outputs two pulses when the photoconductor drum 7 rotates one rotation. The vertical axis indicates the sensor output, and the horizontal axis indicates the time. The times t1 in FIG. 7 is a transit time for a first 180 degree rotation (i.e., a first half rotation). The time t2 in FIG. 7 is another transit time for a second 180 degree rotation (i.e., a second half rotation). The times t1 and t2 are substantially the same. When the gear ratio is 4:1, the motor 40 rotates makes two revolutions in each of the first and second half rotations. Therefore, the patterns of rotations speed fluctuation caused by the eccentricity of the rotation axis of the motor 40 are the same. Therefore, the eccentricity of the rotation axis of the motor 40 cannot be calculated from using the time t1 and t2.

The rotation synchronization signal detection method using the rotation plate 60 can also be used to detect the speed fluctuation caused by eccentricity of the rotation axis of the motor 40. As stated above, when the gear ratio is 4:1, the speed fluctuation of the motor 40 caused by the eccentricity cannot be detected. However, when the gear ratio is changed to a non-integer, the rotation synchronization signal is changed, and thereby, the amplitude and phase of the eccentricity of the rotation axis of the motor 40 can be determined.

By changing the gear ratio (for example, 2.5:1), the phase of the motor 40 shifts by 180 degree when the photoconductor drum 7 makes one revolution. In this case, the speed fluctuation of the rotation axis of the motor caused by the eccentricity appears in the rotation synchronization signal by the rotation plate 60.

Figure 8:
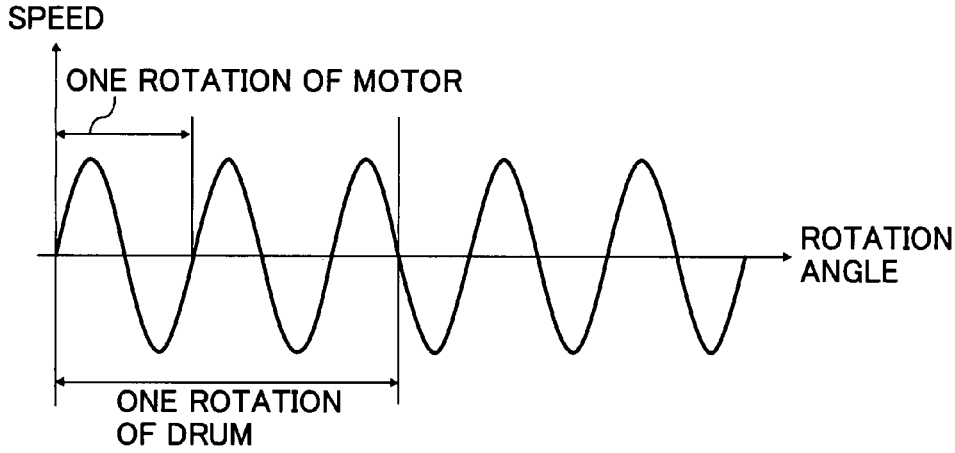
FIG. 8 is a graph illustrating the speed fluctuation of the photoconductor surface when a gear ratio is 2.5:1.

FIG. 8 is a graph illustrates the speed fluctuation of the surface of the photoconductor drum 7 when the gear ratio is 2.5:1. The vertical axis indicates the speed, and the horizontal axis indicates the rotation angle.

As shown in FIG. 8, the rotation speed has the sine-wave fluctuation with respect to the rotation angle. As the gear ratio is 2.5:1, two rotations of the photoconductor drum 7 include five rotations of the motor 40. FIG. 8 illustrates a situation in which the rotation axis of the photoconductor drum 7 has substantially no eccentricity.

Figure 9:
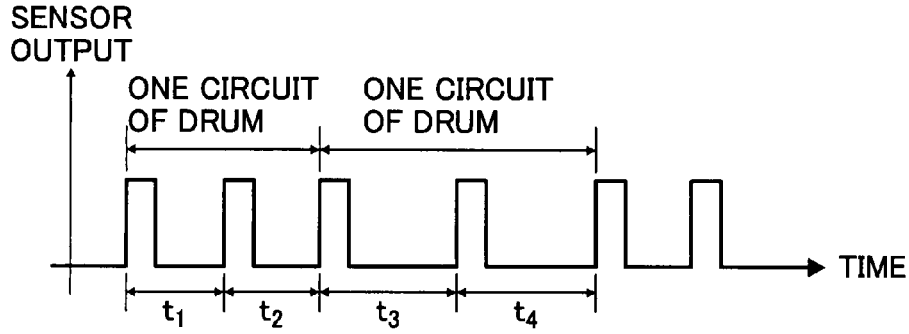
FIG. 9 is a graph illustrating another sensor output when the rotation plate having the slits apart from the other by 180 degree in the rotation direction is used to detect a situation of FIG. 8.

Referring to FIG. 9, the sensor 61 outputs two pluses when the rotation plate 60 having the slits apart from the other by 180 degree in the rotation direction is used to detect the situation illustrated in FIG. 8. As shown in FIG. 9, the sensor 61 outputs the two pluses when the photoconductor drum 7 rotates one rotation. The vertical axis indicates the sensor output, and the horizontal axis indicates the time. The first rotation of the photoconductor drum 7 is made over the first transit time (t1+t2). The second rotation of the photoconductor drum 7 is made over the second transit time (t3+t4). The first transit time (t1+t2) and the second transit time (t3+t4) are different from each other due to different speed fluctuation patterns of the photoconductor drum 7 for the first and second rotations (see FIG. 8).

Therefore, the amplitude and phase of the speed fluctuation caused by the eccentricity of the rotation axis of the motor 40 can be determined by a time relationship (t1+t2)−(t3+t4). The amplitude and phase can also be determined by a time difference (t1−t3) if t1=t2 and t3=t4.

Therefore, the amplitude and phase of the speed fluctuation caused by the eccentricity of the rotation axis of the motor 40 can be determined by the rotation synchronization signal by setting the gear ratio to a non-integer.

Figure 10:
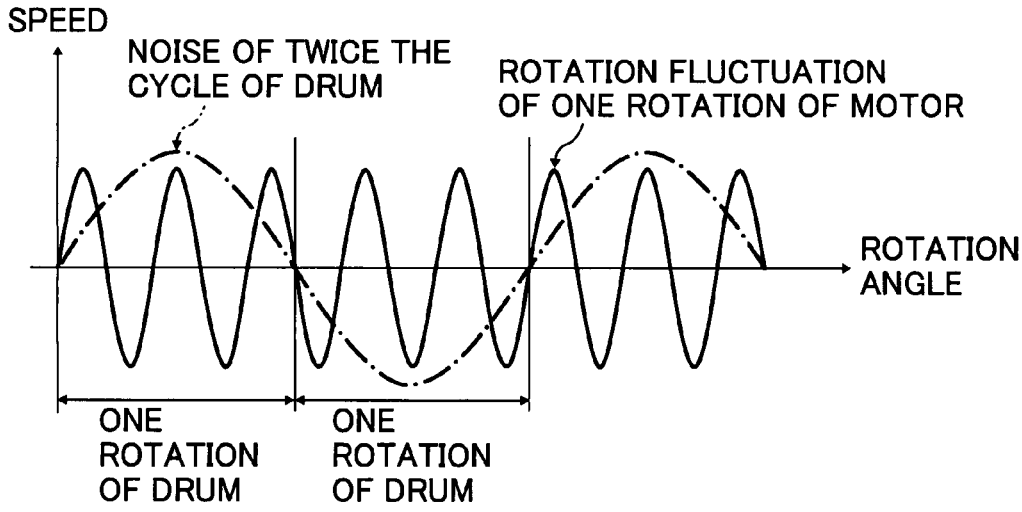
FIG. 10 is a graph illustrating a relationship between the speed fluctuation and a sine-wave noise generated to the photoconductor drum caused by the eccentricity of the motor axis.

However, when the speed fluctuation caused by the eccentricity of the rotation axis of the motor 40 is detected by detecting the time interval of the rotation synchronization signals generated each rotation, for example, the time intervals between the first and second rotations of the photoconductor drum 7, the speed fluctuation caused by the eccentricity may include an error as shown in FIG. 10. For example, when a sine-wave noise having a cycle twice the rotation cycle of the photoconductor drum 7 is added to the eccentricity of the rotation axis of the motor 40, the speed fluctuation caused by the eccentricity may include the error.

FIG. 10 illustrates a relationship between the speed fluctuation caused by the eccentricity of the motor 40 and the sine-wave noise when the gear ratio is 2.5:1. The vertical axis indicates the speed, and the horizontal axis indicates the rotation angle.

As shown in FIG. 10, the rotation speed fluctuation caused by the eccentricity of the rotation axis of the motor 40 has the sine-wave fluctuation with respect to the rotation angle wherein the center line represents the non-eccentric speed. The amplitude is proportional to the eccentricity amount. In the situation illustrated in FIG. 10, the two rotations of the photoconductor drum 7 include five rotations of the motor 40. The added sine-wave noise with a cycle twice the rotation cycle of the photoconductor drum 7 causes the rotation speed fluctuation. This rotation speed fluctuation curve has an opposite phase per rotation of the photoconductor drum 7 as indicated by a dotted line in FIG. 10. Two rotations of the photoconductor drum 7 include one cycle of the speed fluctuation.

Figure 11:
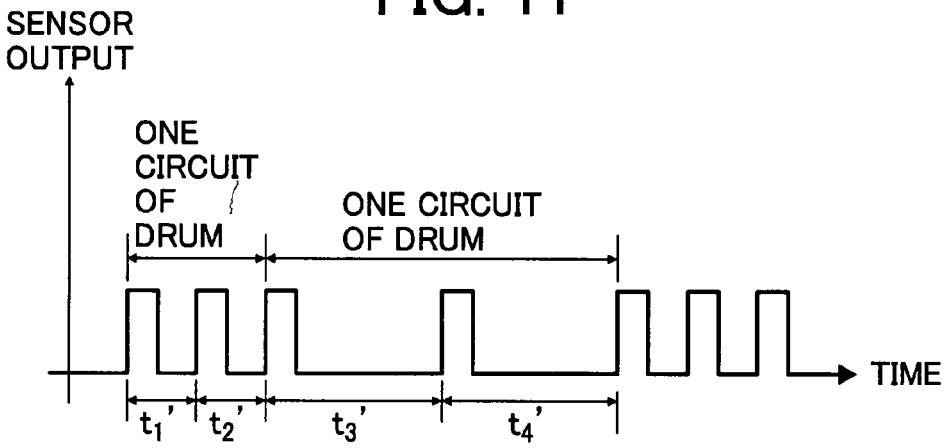
FIG. 11 is a graph illustrating another sensor output when the rotation plate having the slits apart from the other by 180 degree in the rotation direction is used to detect a situation of FIG. 10.

FIG. 11 is a graph illustrates the outputs of the sensor 61 detecting the rotation plate 60. The sensor 61 outputs the pulses when the rotation plate 60 having the slits apart from other by 180 degree in the rotation direction is used to detect the situation illustrated in FIG. 10. As shown in FIG. 11, the sensor 61 outputs the two pulses when the photoconductor drum 7 makes one revolution. The first rotation of the photoconductor drum 7 outputs pulses at a shorter pitch than that in FIG. 9 in which there is substantially no sine-wave noise. The second rotation of the photoconductor drum 7 outputs pulses at a longer pitch than that in FIG. 9.

Accordingly, when the formula above to determine the amplitude and phase of the speed fluctuation caused by the eccentricity of the rotation axis of the motor 40 is applied to the case in which the sine-wave noise with a cycle twice the rotation cycle of the photoconductor drum 7 is added, a correct fluctuation amount cannot be obtained.

Therefore, when a sine-wave noise component of a cycle (plural times the rotation cycle of the photoconductor drum) is added to the fluctuation component of the rotation speed caused by the eccentricity of the rotation axis of the motor 40, each of the speed fluctuation amounts thereof may be detected to control the speed fluctuation. By using the following analytical technique, the rotation signal output of the photoconductor drum 7 in which the sine-wave noise is added to the rotation axis of the motor 40 is analyzed to determine the phase and amplitude for each fluctuation component. Each of the speed fluctuation amounts is obtained based on the determined phase and amplitude. The motor is controlled to adjust speed fluctuation amount so that the photoconductor drum 7 can rotate at the constant speed.

The phase and amplitude for each fluctuation component can be determined by using a method similar to the above described method in terms of detecting and computing the time intervals of pulse trains generated every rotation of the photoconductor drum 7.

However, the analytical technique needs a mechanism to impart the rotation unevenness in form of different kinds of sine-waves to the motor. By using the rotation unevenness, the phase and amplitude for the eccentricity component of the motor axis and sine-wave noise component are determined.

The basics of determining the sine-wave noise component by imparting the rotation unevenness will be described below.

Figure 12:
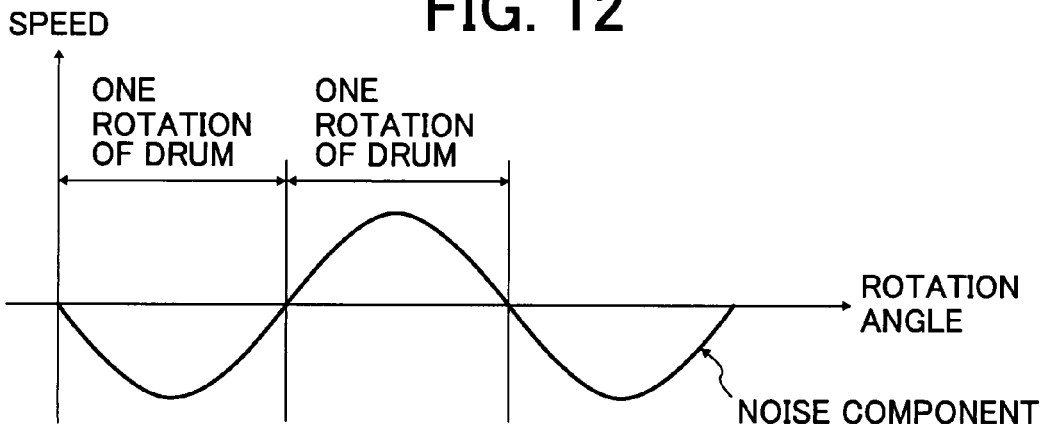
FIG. 12 is a graph illustrating a situation in where the rotation axis of the motor has no eccentricity, and the rotation of the photoconductor drum outputs a noise component at the twice the cycle of the photoconductor drum.

Referring to FIG. 12, the rotation axis of the motor 40 has no eccentricity, and the rotation of the photoconductor drum 7 outputs the noise component at the twice the cycle of the photoconductor drum 7. The vertical axis indicates the speed, and the horizontal axis indicates the rotation angle.

Figure 13:
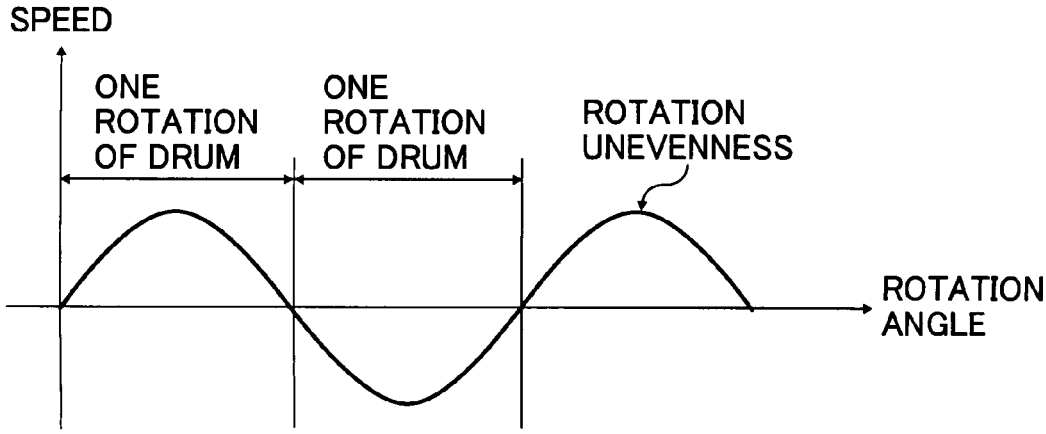
FIG. 13 is a graph illustrating speed fluctuation when rotation unevenness is generated at the twice the cycle of the photoconductor drum by controlling the motor.

Referring to FIG. 13, a control target value to generate the rotation unevenness in form of the sine-waves is provided to the motor.

When the noise component at the twice the cycle of the photoconductor drum 7 is not generated, the rotation unevenness shown in FIG. 13 appears in the rotation fluctuation of the photoconductor drum 7, and the pulse intervals detected by the sensor 61 may be shorter for the first rotation and longer for the second rotation. On the other hand, when the rotation unevenness as the control target value generates the amplitude and noise that are congruent each other in FIG. 12, the amplitude and noise are counteracted each other, and the rotation fluctuation on the photoconductor drum 7 does not exist. Therefore, the pulse intervals detected by the sensor 61 are constant regardless of controlling the motor to generate the rotation unevenness.

Consequently, when there is substantially no difference between the time intervals of the pulse trains, a noise component having a reversed phase compared to the rotation unevenness can be detected.

According to the above basics, the noise component having the cyclic relationship between the rotation cycle of the photoconductor drum 7 and integral multiplication is detected as the sine-wave noise generated in the rotation of the photoconductor drum 7. In a method used in the example embodiment, when the sine-wave noise component is superimposed to the fluctuation component of the rotation speed caused by the eccentricity of the motor axis so as to be output, the amplitude and phase of each fluctuation component can be determined.

When the photoconductor is rotated according to the basics of detecting the eccentricity component and sine-wave noise component, the method used in the example embodiment calculates the amplitude and phase of each fluctuation component in numerical terms based on the detection of the time intervals of the rotation synchronous pulse trains in response to the fluctuation of the rotation speed of the photoconductor drum 7. The rotation synchronous pulse of the photoconductor drum 7 is generated by the rotation plate 60 and sensor 61. The relationship of the rotation plate 60 and sensor 61 will be described below.

Referring to FIG. 14, the rotation plate 60 mounted to the photoconductor drum 7 is illustrated. The rotation plate 60 includes the sensor 61, a first slit S1, and a second slit S2. The sensor 61 located in the certain rotation position detects the first slit S1 and second slit S2 when passing through, and outputs the rotation synchronization signal in form of the pulse in such a manner to be in response to the rotation of the rotation plate 61. The first and second slits S1 and S2 on the rotation plate 60 are apart from each other by 180 degree in FIG. 14. The rotation angle γ is 180 degree. However, the rotation γ may be arbitrary selected.

As shown in FIG. 14, the time interval of the rotation synchronous pulse train for each rotation is a time period between the detection of the slit S1 and the detection of the slit S2. When the sine-wave noise component at the twice the cycle of the photoconductor 7 is generated (described later), the time intervals of the rotation synchronous pulse trains are detected at least two consecutive rotations, so that the phase and amplitude of the fluctuation component are determined.

The rotation plate 60 having the first and second slits S1 and S2 and sensor 61 is capable of detecting the amplitude and phase of the noise without using a high-priced encoder with high-accuracy, for example.

The phase and amplitude of the fluctuation component are determined by calculation of the time intervals of rotation synchronous pulse trains. The calculation will be described below.

When the rotation axis of the motor 40 includes the eccentricity, and the gear ratio is the non-integer, the rotation speed of the photoconductor drum 7 is calculated by adding the rotation speed of photoconductor drum 7 without the eccentricity of the motor axis (ω/2.5) to the speed fluctuation caused by the eccentricity of the motor axis. The expression for the rotation speed of the photoconductor drum is stated below.

$$\text{Rotation speed of the photoconductor drum} = \omega/2.5 + A\sin(\omega t + \alpha_1),$$

in which a definition of each abbreviation is stated below.

ω: Rotation speed of motor (angular speed).

2.5: Gear ratio is 2.5:1.

A: Amplitude of speed fluctuation caused by the eccentricity of motor axis.

$\alpha_1$: Phase of speed fluctuation caused by the eccentricity of motor axis.

When the noise component having the cyclic relationship between the rotation cycle of the photoconductor drum 7 and integral multiplication is superimposed, the rotation speed of the photoconductor 7 is expressed below.

$$\text{Rotation speed of the photoconductor drum} = \omega/2.5 + A\sin(\omega t + \alpha_1) + B\sin(\omega t/5 + \alpha_2),$$

in which a definition of each abbreviation is stated below. As the definitions of ω, 2.5, A, and $\alpha_1$ are substantially the same as above, the descriptions thereof will be omitted.

B: Amplitude of the sine-wave-noise component.

$\alpha_2$: Phase of the sine-wave noise component.

When the photoconductor drum 7 rotates at the above speed, the time period between the detection of the slits S1 and S2 is detected. The angles of the slits S1 and S2 are respectively expressed by the formulas 1 and 2 below.

Formula 1:

$$\int_0^{\tau_1}\left\{\frac{\omega}{2.5} + A\cdot\sin(\omega t + \alpha_1)\right\}dt = \gamma$$

Formula 2:

$$\int_0^{\tau_2}\left\{\frac{\omega}{2.5} + A\cdot\sin(\omega t + \alpha_1) + B\cdot\sin\left(\frac{\omega}{5}t + \alpha_2\right)\right\}dt = \gamma$$

The definition of each abbreviation used in the formulas 1 and 2 is stated below.

ω: Rotation speed of motor (angular speed).

A: Amplitude of the eccentricity of motor axis.

$\alpha_1$: Phase of the eccentricity of motor axis.

B: Amplitude of the sine-wave noise component.

$\alpha_2$: Phase of the sine-wave noise component.

$\tau_1$: Time at which S1 is detected by the sensor.

$\tau_1$: Time at which S2 is detected by the sensor.

γ: Angle between S1 and S2.

This state in which the formulas 1 and 2 are satisfied is used to generate the rotation unevenness in form of the sine-wave to the rotation of the photoconductor drum 7 by providing the control target value to the motor according to the above basics so that the noise component having the cyclic relationship between the rotation cycle of the photoconductor drum 7 and integral multiplication may be detected.

Consequently, two types of the sine-wave rotation unevenness are generated in the example embodiment. One of the types is a waveform of which the rotation cycle is substantially the same as the noise component, and the rotation speed of the photoconductor 7 is superimposed by the rotation unevenness I expressed by the equation below. The phase of the rotation fluctuation caused by the rotation unevenness is zero.

$$\text{Rotation unevenness } I = C\sin\omega t/5,$$

in which a definition of each abbreviation is stated below.

C: Amplitude of the speed fluctuation caused by the rotation unevenness.

When the rotation speed of the photoconductor drum 7 is fluctuated by the eccentricity of the motor axis (formula 1), the noise component having the cyclic relationship between the rotation cycle of the photoconductor drum 7 and integral multiplication (formula 2), and the sine-wave rotation unevenness I, the angle γ at which the rotation plate 60 is rotated to detect the first and second slits S1 and S2 is expressed by the formula 3 below.

Formula 3:

$$\int_0^{T_1}\left\{\frac{\omega}{2.5} + A\cdot\sin(\omega t + \alpha_1) + B\cdot\sin\left(\frac{\omega}{5}t + \alpha_2\right) + C\cdot\sin\frac{\omega}{5}t\right\}dt = \gamma$$

The definition of each abbreviation used in the formula 3 is stated below.

0: Time at which the first slit S1 is detected.

$T_1$: Time at which the second slit S2 is detected with provision of the sine-wave unevenness I (e.g., during the first rotation of the photoconductor drum 7).

A description of abbreviations in formula 3 which have already been described with respect to formula 1 and 2 is omitted.

The angle γ at which the rotation plate 60 is rotated to detect the first slit S1 and the second slit S2 for the second rotation is expressed by the formula 4 below.

$$\int_{T_2}^{T_3-T_2}\left\{\begin{array}{l}\frac{\omega}{2.5}+A\cdot\sin(\omega t+\alpha_1)+\\ B\cdot\sin(\frac{\omega}{5}t+\alpha_2)+C\cdot\sin\frac{\omega}{5}t\end{array}\right\}dt=\gamma$$

The definition of each abbreviation used in the formula 4 is stated below.

$T_2$: Time at which the first slit S1 is detected with provision of the sine-wave unevenness I (e.g., during the second rotation of the photoconductor drum 7).

$T_3$: Time at which the second slit S2 is detected with provision of the sine-wave unevenness I (e.g., during the second rotation of the photoconductor drum 7).

A description of abbreviations in formula 4 which have already been described with respect to formula 1, 2, and 3 is omitted.

Another type of the sine-wave rotation unevenness (referred to as rotation unevenness II) is generated and is superimposed to the noise component. The rotation unevenness II is generated by shifting the phase of the rotation unevenness I by π.

$$\text{Rotation unevenness II}=C\sin(\omega t/5+\pi)$$

When the rotation speed of the photoconductor drum 7 is fluctuated by the eccentricity of the motor axis (formula 1), the noise component having the cyclic relationship between the rotation cycle of the photoconductor drum 7 and integral multiplication (formula 2), and the sine-wave rotation unevenness II, the angle γ at which the rotation plate 60 is rotated to detect the first and second slits S1 and S2 is expressed by the formula 5 below.

Formula 5:

$$\int_{0}^{T_1'}\left\{\begin{array}{l}\frac{\omega}{2.5}+A\cdot\sin(\omega t+\alpha_1)+\\ B\cdot\sin(\frac{\omega}{5}t+\alpha_2)+C\cdot\sin(\frac{\omega}{5}t+\pi)\end{array}\right\}dt=\gamma$$

The definition of each abbreviation used in the formula 5 is stated below.

$T_1'$: Time at which the second slit S2 is detected with provision of the sine-wave unevenness II (e.g., during the first rotation of the photoconductor drum 7).

A description of abbreviations in formula 5 which have already been described with respect to formula 1, 2, 3, and 4 is omitted.

The angle γ at which the rotation plate 60 is rotated to detect the first and second slits S1 and S2 for the second rotation is expressed by the formula 6 below.

Formula 6:

$$\int_{T_2'}^{T_3'-T_2'}\left\{\begin{array}{l}\frac{\omega}{2.5}+A\cdot\sin(\omega t+\alpha_1)+\\ B\cdot\sin(\frac{\omega}{5}t+\alpha_2)+C\cdot\sin(\frac{\omega}{5}t+\pi)\end{array}\right\}dt=\gamma$$

The definition of each abbreviation used in the formula 6 is stated below.

$T_2'$: Time at which the first slit S1 is detected with provision of the sine-wave unevenness II (e.g., during the second rotation).

$T_3'$: Time at which the second slit S2 is detected with provision of the sine-wave unevenness II (e.g., during the second rotation).

A description of abbreviations in formula 6 which have already been described with respect to formula 1, 2, 3, 4 and 5 is omitted.

According to each of the formulas 3 through 6, the angle γ on the rotation plate 60 is expressed in a right-hand side. In other words, the left-hand side of the each of the formulas 3 through 6 is equal. The left-hand side of the formula 3 is equal to that of the formula 4. The left-hand side of the formula 5 is equal to that of the formula 6. Thereby, two equations are derived without the angle γ.

Similar to the calculation of the angle γ and the derivation of the two equations, the angle 2π−γ can be determined. The angle 2π−γ is an angle from the second slit S2 to the first slit S1 on the rotation plate 60.

Therefore, the angle 2π−γ can be determined by performing integration from a time ($T_2-T_1$) to a time $T_2$ in the formula 3. The angle 2π−γ can be determined by performing integration from a time ($T_4-T_3$) to a time $T_4$ in the formula 4. These two formulas determining the angle 2π−γ can be equalized to derive another equation. The values $T_2$, $T_3$ and $T_4$ are detection time at which the first and second silts are detected during the two rotations. The detection of the slits on the rotation plate 60 is sequentially performed by detecting the first slit S1 at which the detection time is zero, the second slit S2 at which the detection time is $T_1$, the first slit S1 at which the detection time is $T_2$, the second slit S2 at which the detection time is $T_3$, and the first slit S1 at which the detection time is $T_4$.

The angle 2π−γ can be determined by using integration time ($T_2'-T_1'$) and $T_2'$ in the formula 5. The angle 2π−γ can be determined by using integration time ($T_4'-T_3'$) and $T_4'$ in the formula 6. These two formulas determining the angle 2π−γ can be equalized to derive another equation. Thereby, the total number of the equations is four.

Among the four equations, the rotation angular speed ω and the sine-wave ration unevenness provided to the rotation of the photoconductor drum 7 are known and/or determined while the amplitude A, phase component $\alpha_1$, amplitude component B, and phase component $\alpha_2$ are not known and/or determined (i.e., unknown variables). As the four equations include the four unknown variables, each of the phase and amplitude may be determined by solving the simultaneous equations.

In the above example embodiment, as the rotation plate 60 includes two silts S1 and S2 located at the rotation angle γ away from each other, the four unknown variables are determined by having two types of the sine-wave rotation unevenness. However, when the rotation plate 60 includes one slit, four types of the sine-wave rotation unevenness may be needed to derive four equations so that the four unknown variables are determined by solving the simultaneous equations.

In the above example embodiment, the gear ratio is 2.5:1. However, the gear ratio may be another non-integer multiplication. The noise component to be detected is added at the twice the cycle of the rotation of the photoconductor drum 7. However, another noise component that is congruent with the cycle of the photoconductor drum 7 at an integral multiple cycle may be detected.

When there are a plurality of the noise components to be detected, for example, the number of different types of the noise components is N, the rotation unevenness for N+1 type can be provided so that the noise components may be detected.

The mechanism generating the rotation synchronous pulse of the photoconductor drum 7 is located on the rotation plate 60 with the slits, and the transmission sensor is used. to detect the transmission lights of the slits in the example embodiment. However, the mechanism may be located on the rotation plate 60 with reflection and non-reflection members, and a reflection sensor may be used to detect the slits. In other words, a configuration that is capable of detecting two location marks, for example, slits, on the rotation plate 60 may be suitable.

The rotation unevenness in form of the sine-wave includes the phase components zero and $\pi$, and the amplitude C in the above example embodiment. However, each of the phase components and amplitude may be replaced with another value.

Therefore, the phase and amplitude of the speed fluctuation of the photoconductor drum 7 are determined. For example, the rotation device 1 as shown in FIG. 3 includes the rotation plate 60 and sensor 61 so that the main controller 10 uses the rotation synchronization signal from the sensor 61 to control the rotation fluctuation of the photoconductor drum 7 based on the calculation result.

Figure 15:
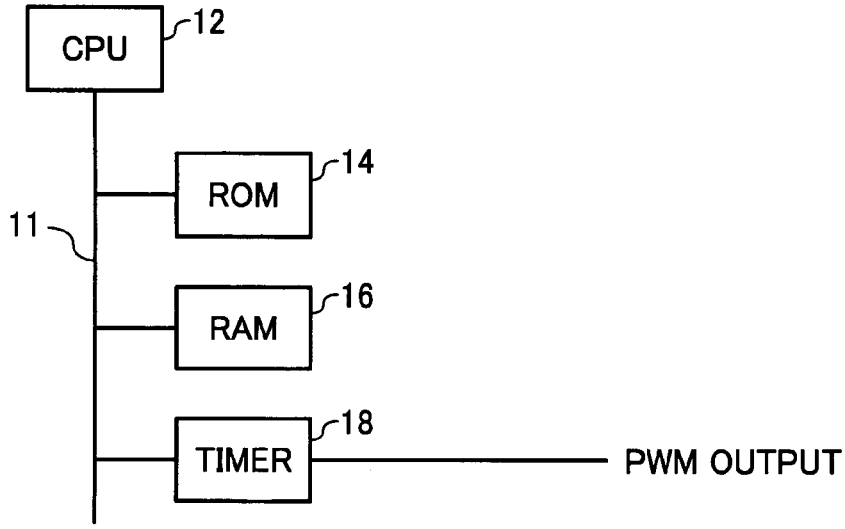
FIG. 15 is a schematic block diagram illustrating an example configuration of the main controller of FIG. 3.

Referring to FIG. 15, one of the example configurations of the main controller 10 is illustrated in a block diagram. The main controller 10 includes a CPU 12, a ROM 14, a RAM 16 and timer 18 that are connected through a bus 11.

The ROM 14 stores a computation program and data including a control papa-meter. The RAM 16 temporarily stores data to be process, for example, the pulse interval detected by the sensor 61, and provides a work-area for the computation when the CPU 12 executes a process including the computation. The CPU 12 executes, for example, a measurement of the time interval of the pulse and the calculation of the amplitude and phase of the speed fluctuation component. These processes including the measurement and calculation are necessary to control the speed of the photoconductor drum 7.

The timer 18 sends a control signal as a pulse width modulation (PWM) clock to the motor controller 20 and controls the rotation speed of the motor 40. The motor controller 20 synchronizes with the PWM clock and rotates the motor 40. An example operation of the timer 18 will be given in FIG. 16.

Figure 16:
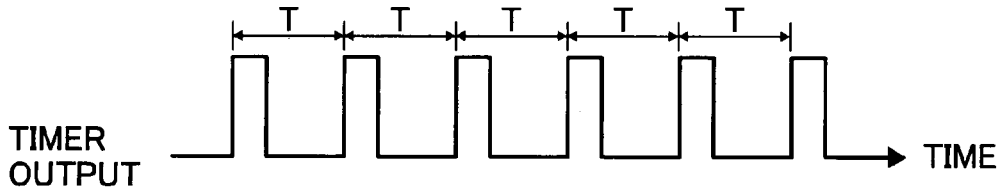
FIG. 16 illustrates an example operation of a timer outputting Pulse Wide Modulation (PWM) of FIG. 15 when the rotation speed of the motor is constant.

Referring to FIG. 16, the timer 18 outputting the PWM is illustrated. When the rotation speed of the motor 40 is arranged to be constant, the PWM output from the timer 18 includes the pulse with a constant cycle as shown in FIG. 16, where the constant cycle is shown in time T. The motor controller 20 controls the motor 40 such that the motor 40 is synchronized with the constant cycle of the PWM clock. Therefore, the motor 40 rotates at the constant speed.

According to the example embodiment, the CPU 12 controls the motor 40 such that the sine-wave rotation unevenness is generated to the rotation of the photoconductor drum 7. This control operation is needed for the main controller 10 as a control function. When the rotation unevenness I that is $C\sin\omega t/5$ is provided to calculate the amplitude and phase of the speed fluctuation component of the photoconductor drum 7, the control target value is arranged by adding rotation speed fluctuation to the constant rotation speed $\omega$. The rotation speed fluctuation is speed that fluctuates at quintuple the rotation cycle of the motor 40. Therefore, the rotation speed of the motor 40 can be controlled at the control target value.

By contrast, when the rotation speed of the motor 40 is controlled at a variable target value, the cycle of the PWM clock output from the timer 18 is varied according to the variable target value. An example operation of the timer 18 will be given in FIG. 17.

Figure 17:
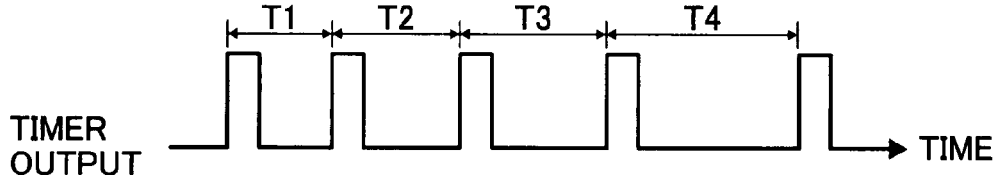
FIG. 17 illustrates another example operation of the timer outputting the PWM of FIG. 15 when the rotation speed of the motor is fluctuated while providing rotation unevenness.

Referring to FIG. 17, the timer 18 outputting the PWM according to the variable target value is illustrated. The rotation speed of the motor 40 may be controlled by the varying the cycle of the PWM clock. When the interval of the clock pulse is increased gradually, for example, T1<T2<T3<T4 as shown in FIG. 17, the motor 40 rotates at slower speed as the motor 40 is controlled in such a manner to be synchronized with the PWM clock. On the other hand, when the interval of the clock pulse is decreased, the motor 40 rotates at faster speed. The amplitude and phase of the clock cycle are varied according to the sine-wave curve that may be arranged arbitrarily. Therefore, the rotation speed of the motor 40 providing the sine-wave rotation unevenness to the photoconductor drum 7 can be controlled.

The timer 18 sends the PWM clock to the motor controller 20 so as to control the rotation speed of the motor. 40 in the above example embodiment. However, a digital-analog converter, for example, may be used to control a voltage level so as to control a rotation number of the motor 40.

The CPU 12 measures the time interval of pulse based on the rotation synchronous pulse generated by the sensor 61 (see FIG. 14) while providing the sine-wave rotation unevenness to the photoconductor drum 7 by controlling the rotation speed of the motor 40. The slits on the rotation plate 60 are sequentially checked for the two rotations. For example, the first slit S1 at which the detection time is zero, the second slit S2 at which the detection time is $T_1$, the first slit S1 at which the detection time is $T_2$, the second slit S2 at which the detection time is $T_3$, and the first slit S1 at which the detection time is $T_4$ are sequentially checked, and each pulse interval time is measured.

The CPU 12 measures the pulse interval time while providing another type of the sine-wave rotation unevenness to the photoconductor drum 7, and the slits on the rotation plate 60 are sequentially checked for the two rotations. For example, the first slit S1 at which the detection time is zero, the second slit S2 at which the detection time is $T_1'$, the first slit S1 at which the detection time is $T_2'$, the second slit S2 at which the detection time is $T_3'$, and the first slit S1 at which the detection time is $T_4'$ are sequentially checked, and each pulse interval time is measured.

The measured pulse interval times act as functions to solve the formulas 3 through 6. By using the functions, the four unknown variables such as the amplitude component A and phase component $\alpha_1$ of the eccentricity of the motor axis and amplitude component B and phase component $\alpha_2$ of the noise are computed by a time base.

The CPU 12 executes correction control based on the computed four variables of the phase and amplitude of the speed fluctuation component. As the eccentricity component of the motor axis and the noise component are analyzed by computing the four variables, the CPU 12 arranges the control target value to which the rotation speed fluctuation is applied such that the components are counteracted. The control target value is arranged based on the computed four variables. Consequently, the CPU 12 executes the correction control by controlling the rotation speed of the motor 40 at the control target value. When the CPU 12 controls the rotation speed of the motor 40 at the variable target value, the PWM clock cycle output from the timer 18 is varied as shown in FIG. 17 according to the variable target value. Consequently, the CPU 12 executes feed-forward control on the rotation speed of the motor 40.

As the rotation speed of the motor 40 is controlled, the speed fluctuation may be reduced, and the rotation of the photoconductor drum 7 may be maintained at the constant speed.

Figure 18:
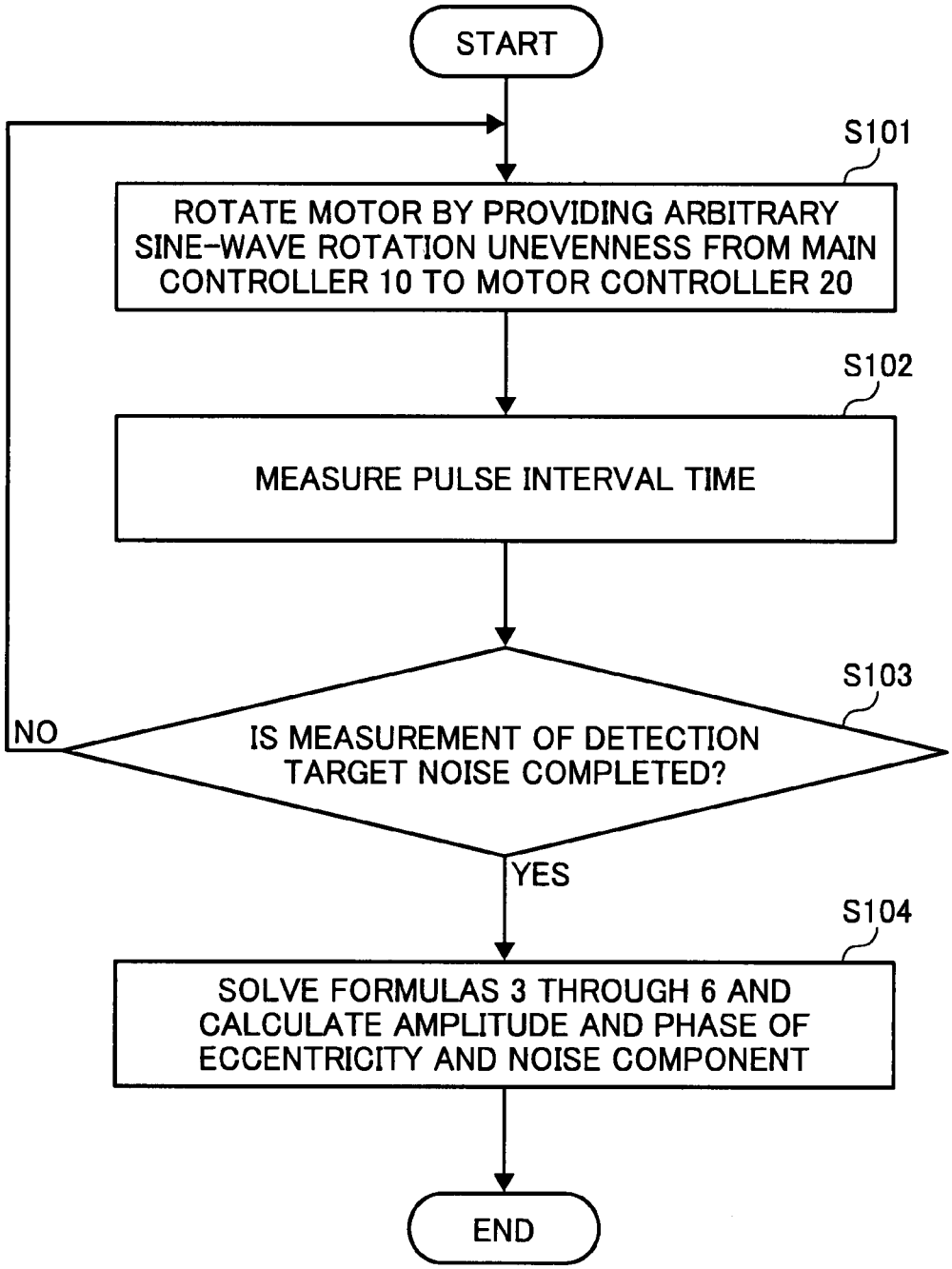
FIG. 18 is an example procedure for computing amplitude and phase of a speed fluctuation component generated to the photoconductor drum.

Referring to FIG. 18, an example procedure for calculating the phase and amplitude of the speed fluctuation component generated in the photoconductor drum 7 is explained. The main controller 10 including the CPU 12 executes this procedure as part of the speed control of the motor 40.

According to the example procedure of FIG. 18, the main controller 10 rotates the motor 40 at rotation speed ω such that the rotation unevenness corresponding to the predicted noise to be generated in the photoconductor 7 is generated to the photoconductor drum 7 (Step S101). In step S101, the main controller 10 arranges the target rotation speed for the motor 40 in such a manner that the sine-wave rotation unevenness capable of arbitrarily defining amplitude and phase generates the rotation unevenness of a first type to the photoconductor drum 7. The PWM clock is output to the motor controller 20 as the control signal according to the target rotation speed arrangement so that the rotation of the motor 40 is controlled.

The motor controller 20 drives and controls the motor 40. The motor 40 generates the rotation unevenness of the first type to the photoconductor drum 7. The photoconductor drum 7 includes the eccentricity component of the motor axis as the speed fluctuation component generated thereto. The photoconductor drum 7 includes the noise component, for example, having the integral multiple cycle of the photoconductor drum 7 as the noise generated thereto. These components are superimposed and appeared as the rotation speed of the photoconductor drum 7.

The sensor 61 detects the rotation synchronization signal of the photoconductor drum 7 of which the rotation speed is fluctuated by detecting the first and second slits S1 and S2 on the rotation plate 60 (see FIG. 14) so that the pulse interval time is measured by the rotation synchronization signal (Step S102). There are two types of the target noise to be detected in the example embodiment.

One of the two types is the eccentricity component of the motor axis, and another type is the noise component having the twice the cycle of the photoconductor drum 7. Each of the noise component includes two unknown variables, and a total of four variable are determined. Therefore, the sensor 61 may need to measure the pulse interval time for two rotations of the rotation plate 60 with respect each type of the rotation unevenness.

When the pulse interval time is measured with respect to the rotation unevenness of one type, the pulse interval time used to determine the variables of the detection target noise is checked whether the measurement is completed (Step S103). As the sensor 61 detects the first and second slits S1 and S2 for the two rotations of the rotation plate 60, the pulse interval time is measured twice, for example, the first to second slits S1 to S2, and the second to first slits S2 to S1. For example, when the number of the unknown variables is two, the measurement is completed.

As the number of the unknown variables is four in the above example embodiment, the example procedure is returned to step S101 (No in Step S103), and the arrangement is modified to generate the rotation unevenness of a second type on the photoconductor drum 7 so as to re-executes steps S101 through S103.

The rotation unevenness of the second type is generated so as to measure the pulse interval time for two rotations of the rotation plate 60. The main controller 10 checks whether the measurement needed to determine the unknown variables with respect to the detection target noise component is completed (Step S103). For example, the number of unknown variable is four in the example embodiment.

The main controller 10 confirms the completion of the measurement of the pulse interval time (Yes in Step S103), and executes a next step to determine a next variable. By using the pulse interval time measured by step S101 through S103, the amplitude and phase of the detection target noise component is calculated based on the functional relationship (Step S104). For example, when the four formulas 3 through 6 in the example embodiment are solved, the measured pulse interval time is applied as the function so that the four unknown variables such as the amplitude component A and phase component $\alpha_1$ of the eccentricity of the motor axis and the amplitude component B and phase component $\alpha_2$ of the noise are computed by the time base.

When the amplitude and phase of the detection target noise is computed, the example procedure of FIG. 18 ends.

In the above example embodiment, the measured pulse interval time is applied to compute the amplitude and phase of the detection target noise component as the process of the computation mechanism. However, fast Fourier transform (FFT) may be applied as the computation mechanism.

Figure 19:
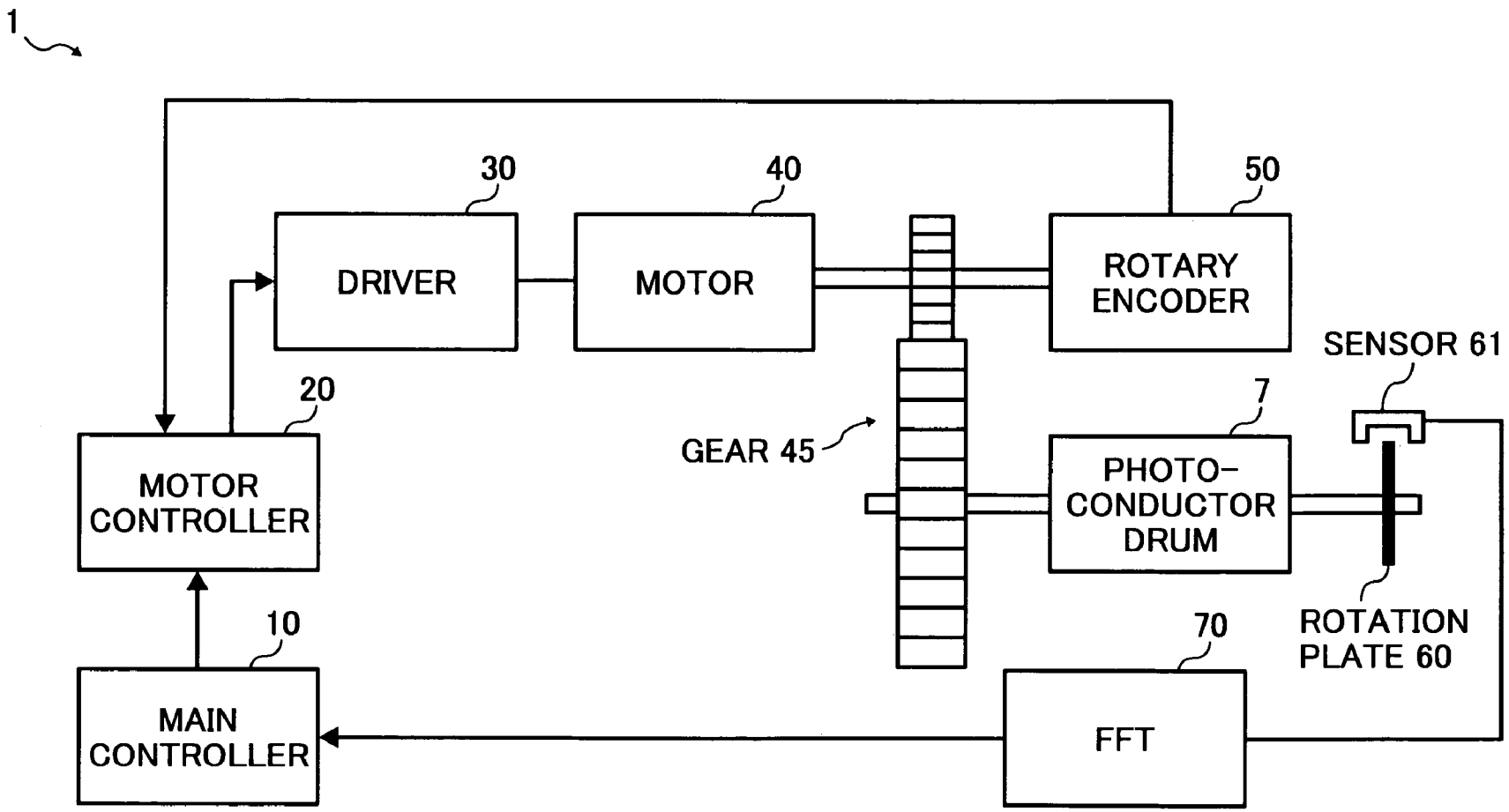
FIG. 19 is a schematic diagram illustrating the rotation device of FIG. 3 with a correction mechanism to correct a plurality of speed fluctuation components generated to the photoconductor drum.

Referring to FIG. 19, the rotation device 1 of the example embodiment including an FFT 70 is illustrated. The FFT 70 is a mechanism to correct a plurality of speed fluctuation components generated in the photoconductor drum 7. As shown in FIG. 19, the rotation device 1 is similar to that of FIG. 3, except for the FFT 70. Reference numerals used in FIG. 19 and FIG. 3 are similar and description thereof will be omitted.

The sensor 61 detects the rotation synchronous pulse of the photoconductor drum 7, and outputs the pulse of the rotation synchronization signal. The FFT 70 receives the rotation synchronization signal, and transmits data including the amplitude and phase of the detection target noise component as an FFT output to the main controller 10.

The FFT 70 computes the input signal by a frequency base, and analyzes a signal frequency. As the FFT 70 is applied to the output pulse from the sensor 61 in this example embodiment, a desired result can be obtained. Therefore, the amplitude and phase of the eccentricity component of the motor axis and the noise component having the integral multiple cycle of the photoconductor drum 7 can be detected as a result of the frequency analysis performed by the FFT 70.

The FFT 70 is disposed outside the main controller 10 in FIG. 17. However, the FFT 70 may be included in the main controller 10 as a computation unit.

In the above example embodiment, two computation mechanisms are described. According to each of the computation mechanisms, the wider variety of the detection target noise components, the higher the detection accuracy of the rotation fluctuation.

However, when the wider variety of the detection target noise components are used, the CPU 12 of the main controller 10 increases a process load and process time to execute the computation of the amplitude and phase. Consequently, the main controller 10 may reduce the efficiency thereof.

When the main controller 10 detects a limited number of the detection target noise components, or a certain type of the detection target noise components that exerts relatively small influence to the rotation fluctuation of the photoconductor drum 7, all of the noise components may not be detected by having an arrangement mechanism. The arrangement mechanism is configured to limit the number and type of the detection target noise components to be detected. Thereby, the main controller 10 can detect the noise component that exerts relatively large influence to the rotation fluctuation so as to increase the efficiency thereof.

As the arrangement mechanism limits the type of the detection target noise components, the CPU 12 reduces the process load, for example, the detection of the pulse interval time and the computation of the amplitude and phase of the noise component. Thereby, the CPU 12 may reduce the computation time and operate appropriately.

According to FIG. 14, the rotation plate 60 and sensor 61 are used as the mechanism to detect the rotation fluctuation of the photoconductor 7. The sensor 61 detects the passage of the first and second slits S1 and S2 on the rotation plate 60, and outputs the rotation synchronous pulse. When such optical mechanism, for example, the sensor 61, is used, an error pulse signal may be generated by disturbance noise including disturbance light. The disturbance noise may result in a malfunction of the optical mechanism such as the sensor 61.

The sensor 61 outputs the rotation synchronous pulse to which the disturbance noise may be randomly generated. The disturbance noise may be reduced by a method in which the pulse interval time is measured more frequently, and a plurality of measured pulse interval times are averaged. When the rotation plate 60 in FIG. 14, for example, generates two pulses during the one rotation and includes the two detection target noise components, the rotation synchronous pulse is detected for at least two rotations. However, as the pulse interval times are measured more frequently in this method, the number of detection to repeat may be n times, for example, 2n rotations. The pulse interval times are measured for 2n rotations, and a plurality of measured pulse interval times are averaged so that the sensor 61 reduces an occurrence of being influenced by the disturbance noise.

According to the above method to reduce the disturbance noise, a plurality of measured pulse interval times are averaged. However, the amplitude and phase of each noise component may be computed from the pulse interval time, and each of the computed pulse interval time may be used to calculate the average value. In other words., a process of measuring the pulse interval time and computing the amplitude and phase of each of noise component based on the measured pulse interval time may repeated a plurality of times. The amplitude and phase of each of the plurality of noise components are computed by the repeated processes, and the computed values are used to calculate the average value. Therefore, the sensor 61 can reduce an occurrence of being influenced by the disturbance noise.

The above disclosure may be conveniently implemented using a conventional general purpose digital computer programmed according to the teachings of the present specification, as will be apparent to those skilled in the computer art. Appropriate software coding can readily be prepared by skilled programmers based on the teachings of the present disclosure, as will be apparent to those skilled in the software art. The present disclosure may also be implemented by the preparation of application specific integrated circuits or by interconnecting an appropriate network of conventional component circuits, as will be readily apparent to those skilled in the art.

Numerous additional modifications and variations are possible in light of the above teachings. It is therefore to be understood that within the scope of the appended claims, the disclosure of this patent specification may be practiced otherwise than as specifically described herein.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program and computer program product. For example, of the aforementioned methods may be embodied in the form of a system or device, including, but not limited to, any of the structure for performing the methodology illustrated in the drawings.

Even further, any of the aforementioned methods may be embodied in the form of a program. The program may be stored on a computer readable media and is adapted to perform any one of the aforementioned methods when run on a computer device (a device including a processor). Thus, the storage medium or computer readable medium, is adapted to store information and is adapted to interact with a data processing facility or computer device to perform the method of any of the above mentioned embodiments.

The storage medium may be a built-in medium installed inside a computer device main body or a removable medium arranged so that it can be separated from the computer device main body. Examples of the built-in medium include, but are not limited to, rewriteable non-volatile memories, such as ROMs and flash memories, and hard disks. Examples of the removable medium include, but are not limited to, optical storage media such as CD-ROMs and DVDs; magneto-optical storage media, such as MOs; magnetism storage media, including but not limited to floppy disks (trademark), cassette tapes, and removable hard disks; media with a built-in rewriteable non-volatile memory, including but not limited to memory cards; and media with a built-in ROM, including but not limited to ROM cassettes; etc. Furthermore, various information regarding stored images, for example, property information, may be stored in any other form, or it may be provided in other ways.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A rotation device comprising:

a rotation member;

a rotation driving source to control a rotation speed of the rotation member;

a transmission mechanism to transmit a rotation from the rotation driving source to the rotation member by decreasing the rotation speed of the rotation driving source, the transmission mechanism decreasing the rotation speed at a non-integer gear ratio;

a rotation pulse generation mechanism to generate a pulse at a rotation angle of the rotation member;

a target value arrangement mechanism to arrange a target value of the rotation speed of the rotation driving source, the target value arrangement mechanism including a rotation unevenness provision mechanism to impart a plurality of kinds of sine-wave unevenness to the rotation speed target value;

a correction value computation mechanism configured to determine the correction value to adjust rotation fluctuation caused by a rotation axis eccentricity component of the rotation driving source and at least one noise component having a cycle relationship with a rotation cycle of the rotation member based on a time interval of a pulse train generated every rotation of the rotation member by the rotation pulse generation mechanism when the plurality of kinds of rotation unevenness are imparted to the rotation speed target value; and a control mechanism to control an output rotation speed of the rotation driving source according to the correction value determined by the correction value computation mechanism.

2. The rotation device of claim 1, wherein the rotation pulse generation mechanism generates one pulse per revolution of the rotation member, and wherein the correction value computation mechanism determines an amplitude difference and a phase difference of each of the rotation axis eccentricity component of the rotation driving source and the at least one noise component having the cycle relationship with respect to the rotation cycle of the rotation member based on time intervals of a plurality of groups of pulse trains obtained by the pulses generated every rotation of the rotation member by the rotation pulse generation mechanism when the plurality of kinds of rotation unevenness are imparted to the rotation speed target value and computes to determine the correction value based on the determined amplitude and phase differences.

3. The rotation device of claim 2, wherein the correction value computation mechanism determines the amplitude and phase differences of each of the rotation axis eccentricity component of the rotation driving source and the at least one noise components having the cycle relationship with the rotation cycle of the rotation member by using a time-based computation method.

4. The rotation device of claim 2, wherein the correction value computation mechanism determines the amplitude and phase differences of each of the rotation axis eccentricity component of the rotation driving source and the at least one noise components having the cycle relationship with the rotation cycle of the rotation member by using a frequency-based computation method.

5. The rotation device of claim 1, wherein the rotation unevenness provision mechanism imparts sine-wave rotation unevenness having an integral multiple cycle of the rotation cycle of the rotation member, and wherein the correction computation mechanism determines an amplitude difference and a phase difference of each of the rotation axis eccentricity component of the rotation driving source and the at least one noise component having the integral multiple cycle with the rotation cycle of the rotation member based on time intervals of a plurality of group of pulse trains obtained by the pulses generated every rotation of the rotation member by the rotation pulse generation mechanism when the plurality of kinds of rotation unevenness are imparted to the rotation speed target value and computes to determine the correction value based on the determined amplitude and phase differences.

6. The rotation device of claim 1, wherein a number of the plurality of kinds of rotation unevenness is equal to a number of the at least one noise components to be corrected by the correction value computation mechanism.

7. The rotation device of claim 1, wherein the correction value computation mechanism determines the time interval of the pulse train generated every rotation of the rotation member by the rotation pulse generation mechanism as an average value of a plurality of samples of the time interval to determine the correction value from the average value.

8. The rotation device of claim 1, wherein the correction value computation mechanism determines an amplitude difference and a phase difference of each of the rotation axis eccentricity component of the rotation driving source and the at least one noise component having the cycle relationship with the rotation cycle of the rotation member based on each of the plurality of samples of the time interval of the pulse train generated every rotation by the rotation pulse generation mechanism to determine the correction value by using average values of the determined amplitude and phase differences.

9. An image forming apparatus, comprising:

a writing device to form an image on a rotation drum by pefforming a line scanning in a main scanning direction; and the rotation device of claim 1 to rotate the rotation drum in a sub-scanning direction.

10. A rotation control method of controlling rotation speed of a rotation member, rotatable by a rotation driving source via a transmission mechanism having a non-integer gear ratio, so as be a rotation speed target value, the rotation control method comprising:

imparting a plurality of kinds of rotation unevenness to the rotation speed target value;

detecting pulses, generated at a rotation angle of the rotation member when the plurality of kinds of rotation unevenness are imparted to the rotation speed target value, to determine a time interval of a pulse train generated every rotation;

determining a correction value, based on the determined time interval of the pulse train, to adjust rotation fluctuation caused by a rotation axis eccentricity of the rotation driving source and a noise component having a cycle relationship with a rotation cycle of the rotation member; and correcting the rotation speed target value using the determined correction value.

11. The rotation control method of claim 10, wherein the detecting includes detecting pulses generated once per rotation of the rotation member, and wherein determining the correction value includes determining an amplitude difference and a phase difference of each of the rotation axis eccentricity of the rotation driving source and the at least one noise component having the cycle relationship with the rotation cycle of the rotation member based on each of a plurality of groups of time intervals of the pulse trains generated every rotation by a rotation pulse generation mechanism to determine the correction value by using the determined amplitude and phase differences.

12. A computer readable medium including program segments for, when executed on a computer device, causing the computer device to implement the method of claim 10.

13. A rotation control device for controlling rotation speed of a rotation member, rotatable by a rotation driving source via a transmission mechanism having a non-integer gear ratio, so as be a rotation speed target value, the rotation control device comprising:

means for imparting a plurality of kinds of rotation unevenness to the rotation speed target value;

means for detecting pulses, generated at a rotation angle of the rotation member when the plurality of kinds of rotation unevenness are imparted to the rotation speed target value, to determine a time interval of a pulse train generated every rotation;

means for determining a correction value, based on the determined time interval of the pulse train, to adjust rotation fluctuation caused by a rotation axis eccentricity of the rotation driving source and a noise component having a cycle relationship with a rotation cycle of the rotation member; and means for correcting the rotation speed target value using the determined correction value.

14. An image forming apparatus, comprising:

a writing device to form an image on a rotation drum by performing a line scanning in a main scanning direction; and the rotation device of claim 13 to rotate the rotation drum in a sub-scanning direction.

* * * * *